US007600834B2

(12) United States Patent
Evans

(10) Patent No.: US 7,600,834 B2
(45) Date of Patent: Oct. 13, 2009

(54) INKJET PRINTER WITH CARBON COPY CAPABILITY

(75) Inventor: Charles E. Evans, Corvallis, OR (US)

(73) Assignee: Marvell International Technology Ltd. (BM)

( * ) Notice: Subject to any disclaimer, the term of this patent is extended or adjusted under 35 U.S.C. 154(b) by 362 days.

(21) Appl. No.: 11/069,188

(22) Filed: Feb. 28, 2005

(65) Prior Publication Data

US 2006/0192795 A1 Aug. 31, 2006

(51) Int. Cl.

| | |
|---|---|
| ***B41J 3/44*** | (2006.01) |
| ***B41J 3/50*** | (2006.01) |
| ***B41J 3/51*** | (2006.01) |

(52) U.S. Cl. ..... 347/2

(58) Field of Classification Search ..... 347/2
See application file for complete search history.

(56) References Cited

U.S. PATENT DOCUMENTS

| | | | | |
|---|---|---|---|---|
| 4,595,303 | A * | 6/1986 | Kuzuya et al. | 400/82 |
| 5,033,887 | A * | 7/1991 | Bauerle | 400/175 |
| 5,748,204 | A * | 5/1998 | Harrison | 347/2 |

* cited by examiner

*Primary Examiner*—Julian D Huffman

(57) ABSTRACT

A printer operable to print on a multi-layer print media includes a non-impact printhead, an impact printhead, and a controller operable to control the non-impact printhead to produce an image on a first layer of the print media and to control the impact printhead to produce a corresponding image on a second layer of the print media.

20 Claims, 3 Drawing Sheets

INKJET PRINTER WITH CARBON COPY CAPABILITY

FIELD OF THE INVENTION

The present invention relates generally to printers, and more particularly, to an inkjet or other non-impact type printers capable of printing through carbon copy media.

BACKGROUND OF THE INVENTION

FIG. 1 shows a typical inkjet printer 10 that emits droplets of ink onto print media 12, such as paper, to create images and text. Inkjet printer 10 includes a printhead (not shown) mounted within a carriage 14 that travels back and forth across the print media 12. The printhead includes an array of tiny nozzles that emit the droplets of ink. As the printhead is moved across the print media 12, a controller activates the printhead to emit droplets of ink at precise locations corresponding to a pattern of pixels of the image being printed.

Ink is typically provided to the printhead by an ink cartridge 16 that is attached to the carriage 14. Depending on the design of the printer 10, the ink cartridge 16 can come in various combinations ranging from a single cartridge for black ink to multiple cartridges for each desired ink color. The ink cartridge 16 may even include the printhead itself. In addition, the ink cartridge 16 may be stationary and separate from the carriage 14.

Different types of inkjet printers emit the droplets of ink in different ways. The two main inkjet technologies currently used by printer manufacturers are thermal bubble and piezoelectric. The thermal bubble method (also known as bubble jet) is used by manufacturers such as Canon and Hewlett Packard. FIG. 2A shows a typical bubble jet printhead 20 used in a thermal inkjet printer. In printhead 20, a heating element 22 such as a resistor creates heat that vaporizes ink in a reservoir 24 to create a bubble. As the bubble expands, a tiny amount of the ink is pushed out of a nozzle 26 onto the paper. When the bubble collapses, a vacuum is created that pulls more ink into the reservoir 24 from the ink cartridge 16 (FIG. 1).

FIG. 2B shows a typical piezoelectric printhead 30 used in a piezoelectric inkjet printer by manufacturers such as Epson. In printhead 30, a transducer 32 such as a piezo crystal is located at the back of an ink reservoir 34. The transducer 32 receives an electric signal that causes it to vibrate. When the transducer 32 vibrates inward toward the reservoir 34, it forces a tiny amount of ink out of a nozzle 36 onto the paper. When the transducer 32 vibrates outward away from the reservoir 34, it pulls more ink into the reservoir 34 from the ink cartridge 16.

Inkjet printers have several advantages when compared to other types of printers, and as a result, inkjet printers have become increasingly popular. First, inkjet printers are capable of very high resolutions. Current inkjet printers can emit droplets of ink as small as 2 picoliters. This allows the printhead to produce images with resolutions exceeding 4800 dots per inch (dpi). Also, because the printhead never actually touches the paper when creating an image, inkjet printers are very quiet during operation. Similarly, because the printhead never touches the paper, inkjet printers are very versatile in that they can print on a wide variety of print media. Finally, inkjet printers are affordable to purchase, and affordable to operate. The ink cartridges they use are cheap, easy to replace, and readily available.

Inkjet printers do, however, have certain limitations. Because inkjet printers are non-impact printers, they are not capable of printing through multi-page print media such as carbon copy forms. Multi-page print media is commonly used in many types of recordkeeping, including accounting bills, invoices, and so on, and in any industry where a duplicate or "carbon copy" is required. Typically, in order to print on multi-page print media, an impact printer such as a dot matrix printer is used. This is because an impact printer is needed to exert sufficient force to the media to transfer the printed images and text to underlying layers of the media. A typical dot matrix printer strikes pins or hammers against an ink ribbon to produce dots on the print media. The pins are housed within a printhead, and a carriage moves both the printhead and the ink ribbon back and forth across the print media. Images and text are created by appropriately positioning numerous individual dots on the print media. As the pins strike a top layer of the multi-page print media, the force of the pins also cause corresponding dots to be printed on underlying layers of the print media. As will be understood by those skilled in the art, where the multi-page print media is carbon paper there are thin pages coated with a waxy pigmented coating placed between sheets of paper. The pressure of the pins striking an upper sheet of paper causes transfer of the pigment to a lower sheet of paper.

FIG. 3 shows a typical printhead 40 used in a dot matrix printer. The printhead 40 includes an array of individual pins 42. The number and arrangement of the pins determine, in part, the resolution of the printed images and text. Current dot matrix printheads typically contain between 9 and 24 pins. However, there are several disadvantages to using dot matrix printers. First, the print quality is relatively poor because the spacing between the pins in the printhead typically determines the spacing between the printed dots. Even when the printhead contains 24 pins the quality is noticeably inferior to inkjet printers. Also, dot matrix printers require special paper to be printed on. Typically, dot matrix printers use tractor-feed continuous paper, where the pages are continuously connected and have holes along both vertical edges. This type of paper has horizontal perforations between the pages so that the pages and vertical edge portions including the holes can be separated after the printing process is completed. Not only is this type of paper expensive and plagued with alignment issues (the holes must be aligned properly for the printer to function properly), but if the user desired to print on carbon copy paper, then the carbon copy paper necessarily has to be restricted to only the tractor-feed continuous type paper. And finally, dot matrix printers are notorious for being noisy during operation.

There is a need for printing high quality documents and for creating duplicate copies of such documents during printing.

SUMMARY OF THE INVENTION

According to one aspect of the present invention, a printer is operable to print on a multi-layer print media. The printer includes a non-impact printhead, an impact printhead, and a controller operable to control the non-impact printhead to produce an image on a first layer of the print media and to control the impact printhead to produce a corresponding image on a second layer of the print media.

DESCRIPTION OF THE INVENTION

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

Figure 1:
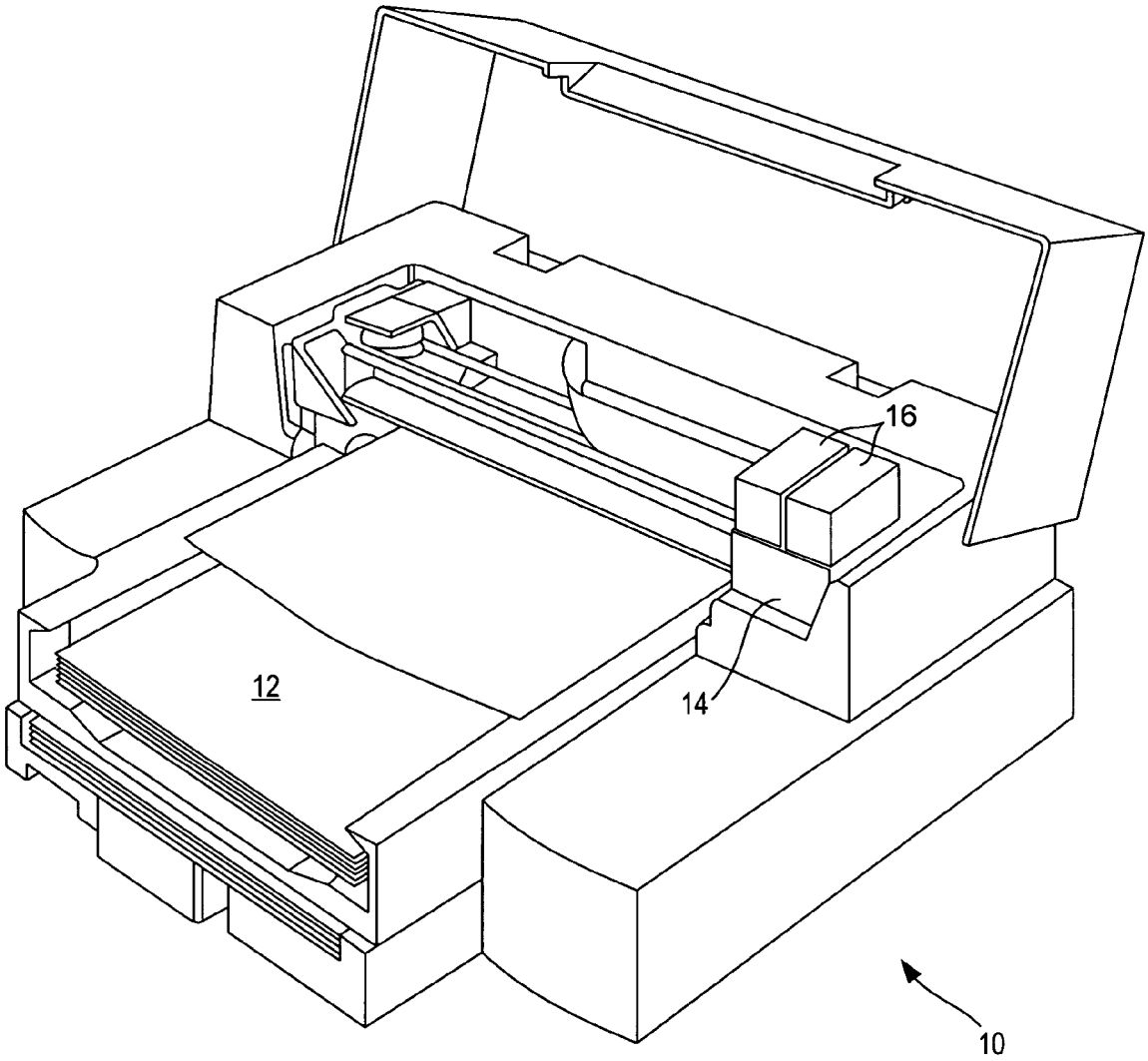
FIG. 1 (Background Art)
FIG. 1 is a perspective view of a conventional inkjet printer.
Figure 2A:
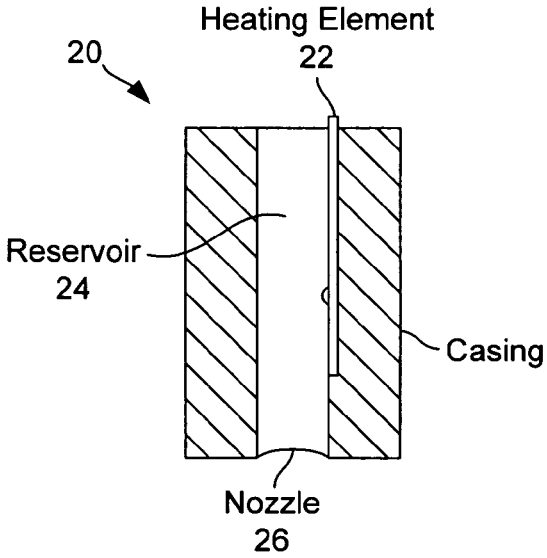
FIG. 2A (Background Art)
FIG. 2A is a cross-sectional view of a conventional bubble jet printhead used in a thermal inkjet printer.
Figure 2B:
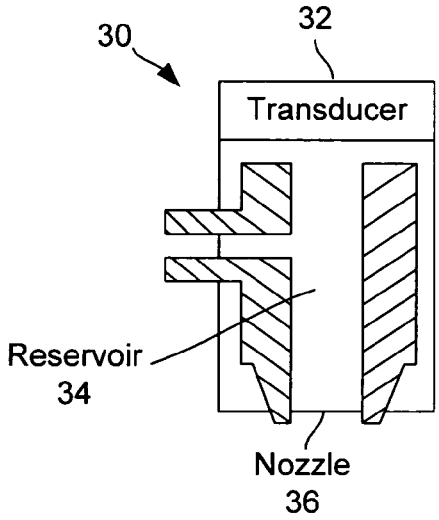
FIG. 2B (Background Art)
FIG. 2B is a cross-sectional view of a conventional piezoelectric printhead used in a piezoelectric inkjet printer.
Figure 3:
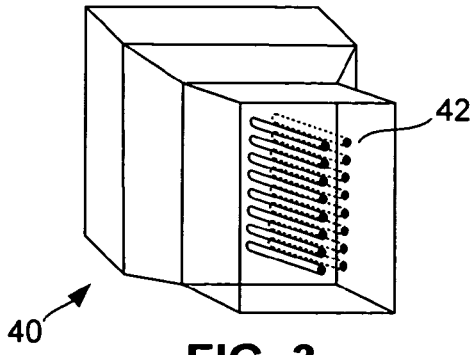
FIG. 3 (Background Art)
FIG. 3 is a perspective view of a conventional dot matrix printhead.
Figure 4:
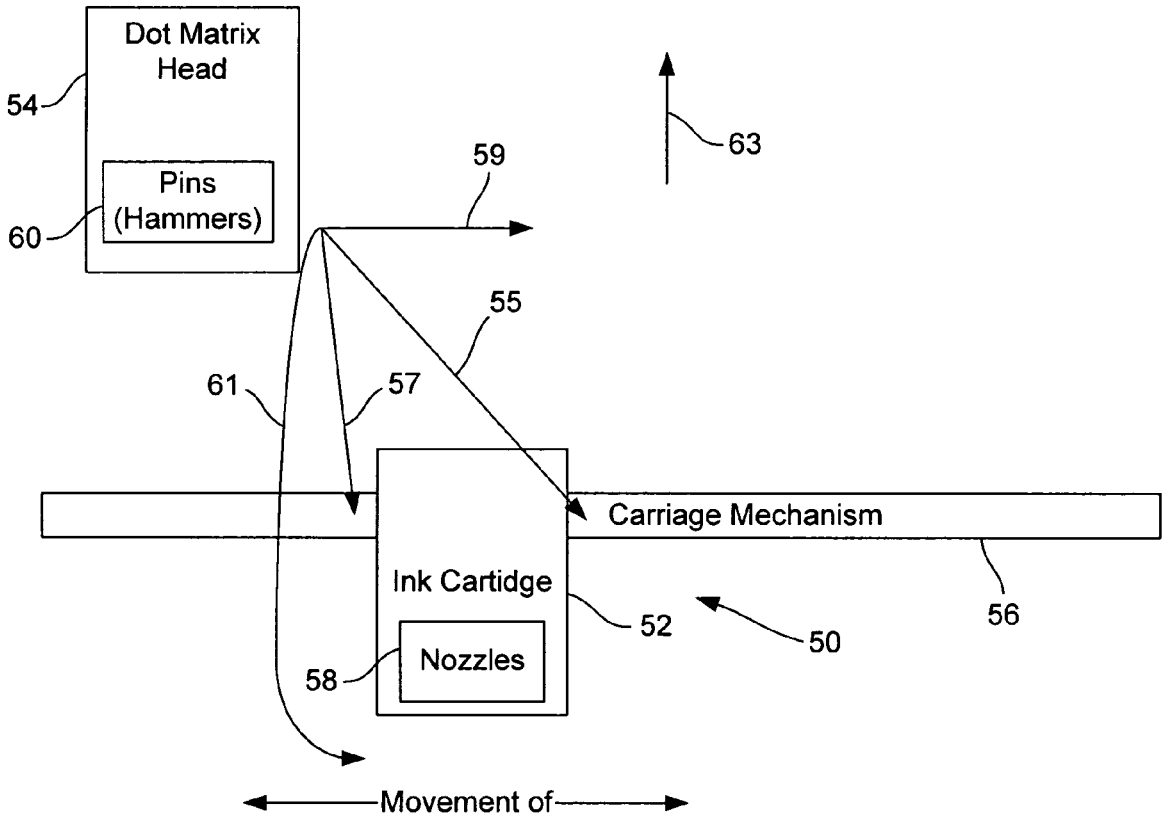
FIG. 4 is a diagram of a print mechanism for a printer according to an embodiment of the present invention.

FIG. 4 shows a print mechanism 50 that may be utilized in the printer 10 of FIG. 1 according to an embodiment of the present invention. Print mechanism 50 includes an inkjet printhead 52, a dot matrix printhead 54 and a carriage mechanism 56. Inkjet printhead 52, which includes an array of nozzles 58, is used to print an image on a top layer of a print media (not shown). Dot matrix printhead 54, which includes an array of pins 60 but does not include an ink ribbon, is used to print a corresponding image on a pressure-sensitive duplicate layer beneath the top layer. Because the print mechanism 50 includes both inkjet printhead 52 and dot matrix printhead 54, the print mechanism 50 is capable of printing on multi-layer media as well as single-layer media. In this way, the print mechanism 50 prints high resolution image on the top layer of the print medium while also printing duplicate images on underlying layers of the print medium.

The dot matrix printhead 54 may be positioned on either side of the inkjet printhead 52 along the carriage mechanism 56, generated by arrows 55 and 57 The carriage mechanism 56 moves both inkjet printhead 52 and dot matrix printhead 54 simultaneously across the print media. Having the printheads 52 and 54 side-by-side along the carriage mechanism 56 allows for several options when printing on multi-layer media. If the printheads 52 and 54 are controlled to print the exact same data simultaneously, then the data of inkjet printhead 52 will be offset from the data of dot matrix printhead 54. The distance between printheads 52 and 54 determines the amount of offset between the data. The printheads 52 and 54 may alternatively be controlled to begin and end printing at slightly different times. This enables the data printed by the dot matrix printhead 54 to be aligned with the output of inkjet printhead 52. For example, assume the dot matrix printhead 54 is positioned next to and to the right of the inkjet printhead 52 in FIG. 4. As the carriage moves printheads 52 and 54 from left to right, the data being printed by the inkjet printhead 52 may be aligned with the data being printed by the dot matrix printhead 54 by delaying the data for the inkjet printhead (inkjet data) relative to the data for the dot matrix printhead (dot matrix data). If the dot matrix printhead 54 passes over a given point on the print media and the inkjet printhead 52 passes over this same point a delay time TD later, then by delaying the printing of the inkjet data by the delay time TD relative to the dot matrix data the two sets of data will be aligned on the top and underlying layers of the print media. The opposite is true as the carriage moves the printheads 52 and 54 from right to left across the print medium. In this situation the inkjet data is advanced relative to the dot matrix data, which may be viewed as the dot matrix data now being delayed by the delay time TD relative to the inkjet data.

In another embodiment, one of the printheads (for example inkjet printhead 52) is controlled to first print an entire line of data and then the other printhead (for example dot matrix printhead 54) is controlled to print the same line of data again before advancing the print media. In this way, the data being printed by inkjet printhead 52 on the top layer of the print media is aligned with the data being printed by dot matrix printhead 54 on the underlying layers of the print media.

In a second embodiment, the dot matrix printhead 54 may be positioned either above or below the inkjet printhead 52 relative to the direction of travel of the print media. Arrows 59 and 61 in FIG. 4 illustrate the dot matrix printhead 54 positioned above and below, respectively, the inkjet printhead 52 relative to the direction of travel of the print media indicated by an arrow 63. The carriage mechanism 56 still moves both inkjet printhead 52 and dot matrix printhead 54 simultaneously across the print media, except now the printheads 52 and 54 travel along separate but parallel lines. Having the printheads 52 and 54 lined up along the direction of travel 63 of the print media allows several operational options when printing on multi-layer media. If the printheads 52 and 54 are controlled to print the exact same data simultaneously, then the output of inkjet printhead 52 will be vertically offset from the output of dot matrix printhead 54, where the direction of travel 63 of the print media is termed the vertical direction. Once again, the amount of offset will be determined by the distance between printheads 52 and 54. Alternatively, to eliminate this vertical offset, the lower printhead relative to the direction of travel 63 of the print media (for example inkjet printhead 52) can be controlled to first print an entire line of data. The print media is then advanced by the vertical distance between printheads 52 and 54, and then the higher printhead (for example dot matrix printhead 54) is controlled to print the same line of data. In this way, the data printed by inkjet printhead 52 is aligned with the data printed by dot matrix printhead 54. For this configuaration of the dot matrix printhead 54 positioned either above ore below the inkjet printhead 52, the data printed by the two printheads may be appropriately delayed to eliminate vertical offsets in the data in a manner analogous to that previously described above for horizontal positioning of the two printheads.

In any of the previously described embodiments, the print mechanism 50 may operate in both an inkjet mode and a hybrid inkjet/dot matrix mode. The user is able to select in which mode the print mechanism 50 will operate based on the type of print media being used. If a single-layer medium is used, then the user may select the inkjet mode where the print mechanism 50 utilizes only the inkjet printhead 52. If a multi-layer medium is used, such as when duplicate copies are required, then the user may select the hybrid mode where the print mechanism 50 utilizes both the inkjet printhead 52 and the dot matrix printhead 54.

Because the print mechanism 50 may operate in both an inkjet mode and a hybrid inkjet/dot matrix mode, the print mechanism 50 is compatible with a wide variety of print media. In the inkjet mode, the print mechanism 50 is capable of printing on any print media compatible with an inkjet printer. Typically, this includes a wide variety of single-layer media. In the hybrid mode, the print mechanism 50 is capable of printing on any multi-layer media that is similar in shape to print media compatible with an inkjet printer. As a result, the print mechanism 50 is not restricted to only a certain type of multi-layer media (like a typical dot matrix printer). Furthermore, this reduces the operating costs of a printer including the print mechanism 50 because less costly print media may be used compared to the expensive tractor-feed paper used by typical dot matrix printers.

The print mechanism 50 is also capable of producing higher quality images than a typical dot matrix printer. By utilizing the inkjet printhead 52, the print mechanism 50 is able to produce images with resolutions exceeding 4800 dpi. However, when printing on multi-layer media, this resolution is only realized on the top layer because the dot matrix printhead 54 is used to produce the corresponding image on the underlying layer such as with carbon copy paper. This is typically not an issue because high resolutions are not usually required for carbon copies, and the details of a high resolution image would normally be lost anyway when being transferred to a carbon copy page.

The print mechanism 50 also makes significantly less noise during operation when compared to a typical dot matrix printer. This is because the dot matrix printhead 54 is able to use significantly less force when striking the pins 60 against the print medium. Significantly less force may be used because dot matrix printhead 54 does not use an ink ribbon between the pins 60 (see FIG. 4) and the top layer or page of the print media.

There are also various other embodiments of the present invention. The inkjet printhead 52 may be any type of inkjet printhead, including thermal bubble and piezoelectric. Moreover, inkjet printhead 52 may be replaced with any type of non-impact printing device, such as a laser printing assembly for laser printing pages. The concepts and principles described herein are thus not limited to being applied to inkjet printers, but apply to other non-impact type printers as well, such as laser printers. Also, dot matrix printhead 54 may contain any number or arrangement of pins, depending on the desired resolution. Moreover, dot matrix printhead 54 may be replaced with any type of impact printing head because no ink ribbon is needed. Finally, the print mechanism may make varying numbers of passes with the printheads 52 and 54 over the print media, with a greater number of passes generating higher potential resolution of data being printed on the print media. Also, in another embodiment, a retrofit kit including the dot matrix printhead 54 and other required components may be made to allow a user to upgrade an existing inkjet printer to print on multi-layer print media. One skilled in the art will understand suitable control circuitry and modifications to existing control circuitry contained in conventional inkjet printers to control the print mechanism 50 and implement the functionality described for the described embodiments of the present invention.

From the foregoing it will be appreciated that, although specific embodiments of the invention have been described herein for purposes of illustration, various modifications may be made without deviating from the spirit and scope of the invention.

What is claimed is:

1. A printer operable to print on a multi-layer print media, the printer comprising:

a non-impact printhead;

an impact printhead; and a controller operable to control the non-impact printhead to produce a first print job on a first portion of a first layer of the multi-layer print media and to control the impact printhead to impact the multi-layer print media on a second portion of the first layer of the multi-layer print media where the impact printhead produces a second print job on a second layer of the multi-layer print media where the second print job is at least partly the same as the first print job, where the impact printhead is configured not to produce a printed image on the second portion of the first layer of the multi-layer print media.

2. The printer of claim 1, wherein the non-impact printhead comprises either an inkjet printhead or a laser printer assembly.

3. The printer of claim 2, wherein the inkjet printhead comprises either a thermal bubble printhead or a piezoelectric printhead, and wherein the impact printhead comprises a dot matrix printhead.

4. The printer of claim 1, wherein the impact printhead is positioned horizontally adjacent to the non-impact printhead.

5. The printer of claim 1, wherein the controller controls the non-impact printhead and the impact printhead to operate simultaneously.

6. The printer of claim 1, wherein the controller controls the non-impact printhead and the impact printhead to operate at separate times.

7. The printer of claim 1, wherein the impact printhead is positioned vertically adjacent to the non-impact printhead and further comprising a buffer memory for storing image data.

8. The printer of claim 1, wherein the multi-layer print media comprises a carbon copy.

9. The printer of claim 1, wherein the printer is further operable to print on a single-layer medium.

10. The printer of claim 1, where the second portion of the first layer of the multi-layer print media is located at substantially the same position as the first portion of the first layer of the multi-layer print media.

11. The printer of claim 1, where the second print job is substantially the same as the first print job.

12. A method of printing on a multi-layer media having a top layer and at least one underlying layer, the method comprising:

depositing ink on a first portion of the top layer during a first automated print operation to print a print job on the top layer; and impacting a second portion of the top layer during a second automated print operation to print a print job on the underlying layer, wherein the print job on the underlying layer is at least partly the same as the print job on the top layer and wherein impacting the second portion of the top layer comprises using an impact printhead configured not to produce a printed image on the second portion of the top layer of the multi-layer media.

13. The method of claim 12, wherein depositing comprises using a non-impact printhead to produce an image on the top layer.

14. The method of claim 13, wherein the non-impact printhead comprises either an inkjet printhead or a laser assembly.

15. The method of claim 12, wherein impacting comprises using the impact printhead to produce a corresponding image on the underlying layer.

16. The method of claim 12, wherein the impact printhead comprises a dot matrix printhead.

17. The method of claim 12, wherein depositing ink on the top layer and impacting the top layer occurs simultaneously.

18. The method of claim 12, wherein depositing ink on the top layer and impacting the top layer occurs at separate times.

19. The method of claim 12, where the second portion of the top layer of the multi-layer media is located at substantially the same position as the first portion of the top layer of the multi-layer media.

20. The method of claim 12, where the second print job is substantially the same as the first print job.

* * * * *